United States Patent [19]

Schmidt et al.

[11] Patent Number: 5,033,905

[45] Date of Patent: Jul. 23, 1991

[54] MOVABLE BARRIER

[75] Inventors: Eric J. Schmidt, 534 Silverado Dr., Tiburon, Calif. 94920; Andrew Nagy, San Rafael, Calif.

[73] Assignee: Eric J. Schmidt, Tiburon, Calif.

[21] Appl. No.: 361,480

[22] Filed: Jun. 5, 1989

[51] Int. Cl.[5] ..... E01F 13/00; E01F 15/00

[52] U.S. Cl. ..... 404/6; 404/9; 256/13.1

[58] Field of Search ..... 404/6, 9; 256/1, 13.1; 49/49; 40/606, 612

[56] References Cited

U.S. PATENT DOCUMENTS

| | | | |
|---|---|---|---|
| 2,927,513 | 3/1960 | Dove | 256/13.1 |
| 3,250,032 | 5/1966 | Von Gal, Jr. et al. | 40/606 |
| 3,335,534 | 8/1967 | Hester et al. | 256/13.1 |
| 3,391,620 | 7/1968 | Mahoney | 404/6 |
| 3,572,223 | 3/1971 | Vierregger | 404/9 |
| 4,269,534 | 5/1981 | Ryan | 256/1 |
| 4,498,803 | 2/1985 | Quittner | 404/6 |
| 4,500,225 | 2/1985 | Quittner | 404/6 |
| 4,592,158 | 6/1986 | Seely | 40/606 |
| 4,596,489 | 6/1986 | Mariol et al. | 404/9 |
| 4,624,601 | 11/1986 | Quittner | 404/12 |
| 4,681,302 | 7/1987 | Thompson | 404/6 |

*Primary Examiner*—Ramon S. Britts
*Assistant Examiner*—Gay A. Spahn
*Attorney, Agent, or Firm*—Townsend and Townsend

[57] ABSTRACT

This invention relates to a road barrier, particularly to a road barrier for separating traffic lanes on a bridge. In the preferred embodiment, the barrier is made up of beams formed from steel three-beam guardrail sections. Steel tubes or flanges are welded to the top and bottom of the guardrail sections and a transverses stiffener is welded to one side. The barrier's sections are removable mounted by pins in anchors attached to the bridge deck.

27 Claims, 3 Drawing Sheets

MOVABLE BARRIER

BACKGROUND OF THE INVENTION

This invention relates to barriers in general and, in particular, to traffic barriers.

Traffic barriers separate lanes of automobile traffic. Such barriers find particular use in separating lanes of oppositely flowing traffic, although they are also useful for separating lanes of traffic flowing in the same direction and for separating traffic from pedestrians or from dangerous conditions along the road.

One particular application of traffic barriers is in separating lanes of traffic on bridges. To make optimum use of the limited width, bridges often have little or no space between oppositely flowing lanes of traffic, thereby creating a potentially dangerous situation. Placing traffic barriers between the oppositely directed traffic lanes minimizes this danger.

Prior art bridge traffic barriers fall into two categories: permanent barriers and movable barriers. Because they may be firmly attached to the bridge surface, permanent barriers are more resistant to vehicle impacts and therefore tend to be more effective traffic separators than movable barriers. One drawback to permanent barriers, however, is their immobility. To make optimum use of the limited number of lanes on a bridge, traffic engineers may change the direction of the flow on one or more of the bridge lanes to accommodate the vehicle traffic demand. Thus, permanent barriers are effective for separating oppositely flowing traffic only if the direction of the traffic flow remains the same for the lanes on either side of the barrier.

Movable barriers are one solution to the problem of separating traffic flow on bridge lanes with changeable traffic flow directions. Such barriers may be moved from one lane to another as the traffic flow demands. Prior art movable barriers, however, suffer from two major deficiencies. First, movable barriers must provide vertical stability in order to withstand vehicle impacts. Prior art movable barriers therefore usually have a wide base resting against the bridge road surface. This wide base is unacceptable on most bridges where vehicle space is at a premium. What is needed, therefore, is a movable barrier whose width does not interfere with vehicle traffic on either side of the barrier.

The second deficiency of prior art movable barriers is the relatively long time it takes for bridge workers to move the barriers from one lane to another. The process of moving the barriers often requires the closing of two lanes of traffic, an undesirable situation on busy bridges. What is needed, therefore, is a movable barrier design which reduces the moving time and minimizes the disruption of traffic flow on the bridge during the move.

SUMMARY OF THE INVENTION

This invention meets these and other needs by providing a movable barrier which is narrow in width and which can be moved quickly and easily from one lane to another. In the preferred embodiment, a beam is attached to an anchor in the road surface be pins. The beam is made from a combination of steel three-beam guardrail sections and steel tubes. The beam and pins may be lifted out of the anchor and moved to a new location.

The invention is described more particularly below with reference to the drawings.

DETAILED DESCRIPTION OF THE PREFERRED EMBODIMENT

Figure 1:
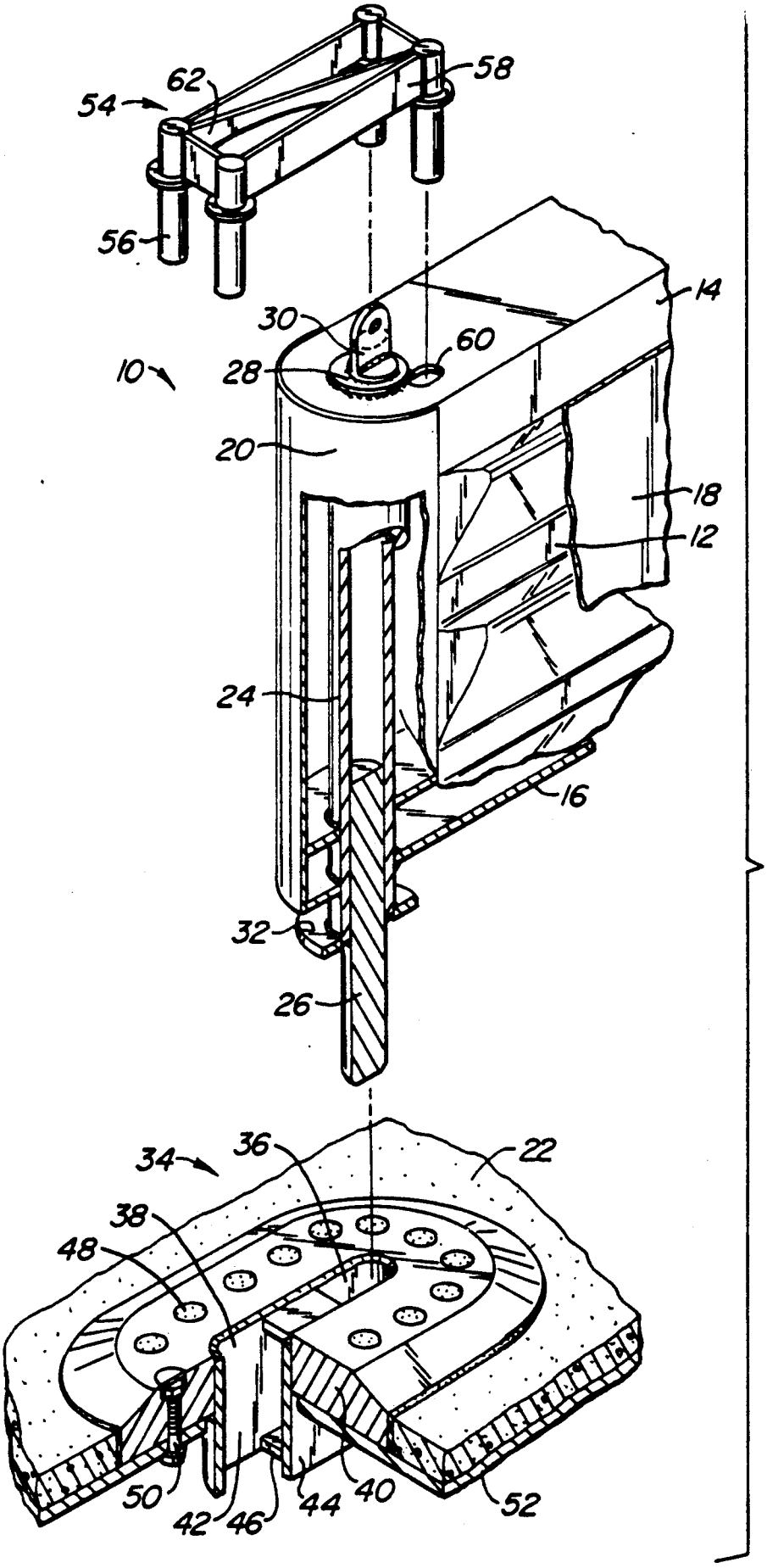
FIG. 1 is an exploded partial sectional view of the preferred embodiment of this invention.
Figure 1A:
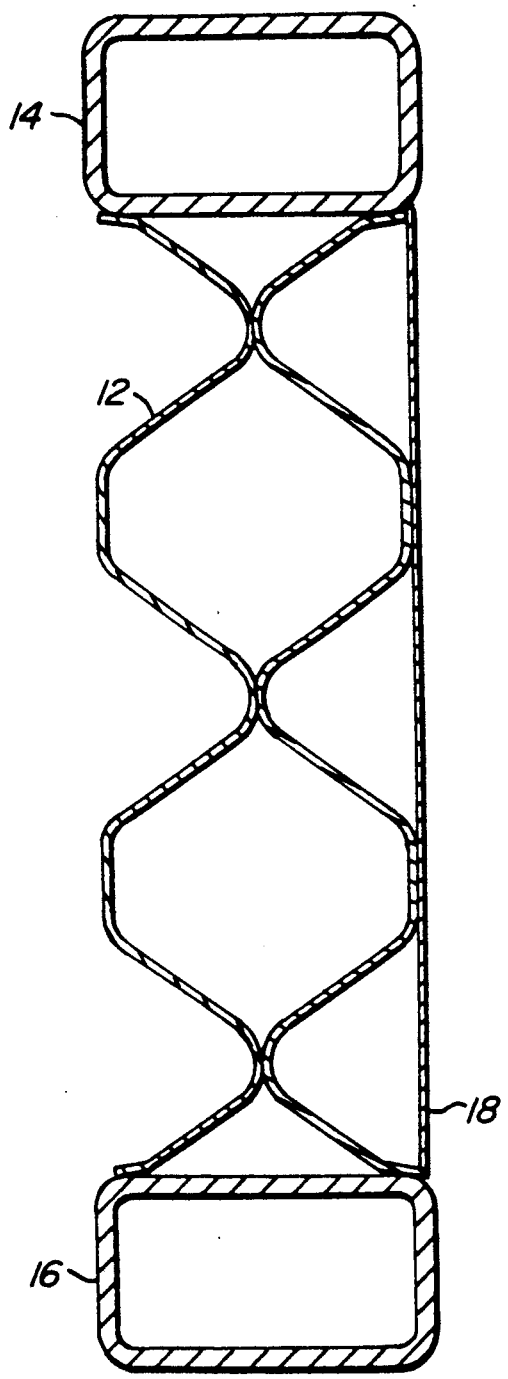
FIG. 1A is an endwise sectional view of a portion of the barrier.

FIGS. 1 and 1A show a movable barrier 10 according to the preferred embodiment of this invention. Barrier 10 is formed from two pieces of corrugated metal spot-welded together to form a unitary deflector beam 12 having an hourglass cross-sectional shape. The metal pieces may also be attached to each other by bolts or by any other suitable means. Preferably, beam 12 consists of two three-beam guardrail sections cold-rolled from ASTM 572 Grade 50 steel, with a minimum guaranteed yield strength of 50,000 psi. Alternatively, deflector beam 12 may be formed from any other material meeting the size and strength requirements.

Rectangular tubes or flanges 14 and 16 are attached longitudinally at the top and bottom of deflector beam 12 by continuous ⅛ inch fillet welds. In the preferred embodiment, flanges 14 and 16 are structural tubes 7×4×3/8 inch size, fabricated of ASTM A500 Grade B steel. If more than one tube must be used to make a single section of flange, multiple tubes may be spliced together in a manner known in the art. Splicing welds in the top and bottom flanges should be staggered. Alternative materials and methods of attachment may also be used.

Transverse stiffeners 18 are attached to the beam to increase the torsional rigidity of the barrier section. In the preferred embodiment, the stiffeners are 10 Gauge steel sheets, ASTM A572 Grade 50, 6 feet 2 inches long and 20 inches high. Stiffeners 18 are attached to the beams by continuous ⅛ inch fillet welds.

The ends of deflector beam 12 and tubes 14 and 16 are provided with blunt closure members 20 formed from bent 10 Gauge plates, ASTM A572, Grade 50. Closure members 20 are welded to the barrier sections by ⅛ inch fillet welds.

FIG. 1 also shows the mechanism by which movable barrier 10 is attached to the bridge surface 22. A metal tube 24 is welded to deflector beam 12 approximately 4 inches from each end. In the preferred embodiment, tube 24 is a 3.5 inch diameter double-extra strong pipe, ASTM A53, Type S, Grade B. Tube 24 extends slightly beyond top flange 14 and about six inches beyond bottom flange 16. Tube 24 is attached to beam 12 by continuous fillet welds. Alternatively, the tubes may be formed from plastic or replaced by solid bars.

A 2.3 inch diameter steel pin 26, ASTM A588, is welded into the bottom of each pipe or tube 24. A 5/8 inch thick disk 28 is welded into the top of each pipe or tube 24. A 5/8 inch thick lifting lug 30 is welded to the top of each disk 28 to facilitate movement of the barrier. A second disk 32 having a six inch outer diameter is welded to the bottom of each pipe 24 to provide a stop against the mounting surface on the road. Both disks 28 and 32 and the lug 30 are ASTM A36 steel in the preferred embodiment.

The bridge surface 22 must be modified to accommodate the traffic barrier of the invention. As shown in FIG. 1, an anchor unit 34 is mounted below the bridge surface 22. Anchor unit 34 has sockets 36 and 38 which mate with the barrier to hold it in place.

The socket plate 40 is oblong in shape, 14.55 inches by 26.55 inches in the preferred embodiment. Plate 40 is machined to a thickness of three inches in the center and two inches at the edge. The preferred material is ASTM A588 corrosion-resistant, high-strength, low alloy steel.

An oblong slot 42 which is 13.55 inches long by 3.55 inches wide is milled symmetrically about both centerlines of socket plate 40. Disposed in slot 42 is a hot-bent plate 44 whose outside dimensions conform to the inside dimensions of slot 42. Hot-bent plate 44 is welded to socket plate 40 and extends 8 inches down from the top of socket plate 40. A steel divider 46 extends across hot-bent plate 44 along the short axis thereof to add strength to the socket.

Fourteen 13/16 inch diameter holes 48 are formed in socket plate 40 to receive 3/4 inch diameter, 3½ inch long ASTM A490 high strength steel bolts 50. Bolts 50 extend through socket plate 40 and the bridge deck 52. Heavy hex nuts and split washers under the nuts are used to attach the socket plates 40 to the bridge surface. The top part of each hole is milled out to receive the nut attached to the top of the bolt. After installing the bridge deck sockets, the gaps surrounding the sockets and the bolts are filled with epoxy asphalt filler compound.

To provide greater strength to withstand collisions from motor vehicles, an end-lock assembly 54 is mounted between adjacent barriers 10. Assembly 54 consists of four 1.25 inch diameter steel pins 56 connected by 2×¼ inch rectangular cross-section bars 58, the 2 inch dimension being aligned vertically. Slotted holes 60 are provided in the top and bottom plates of the top flange tube 14 to receive pins 56. Slots 60 are oval-shaped, 1.31 inch by 1.81 inch, to provide for placement tolerances and thermal expansion. The steel preferably conforms to ASTM A36 standards. The 2 inch dimension of the diagonal bar 62 may be machined down to ¾ inch to facilitate removal of assembly 54.

Figure 2:
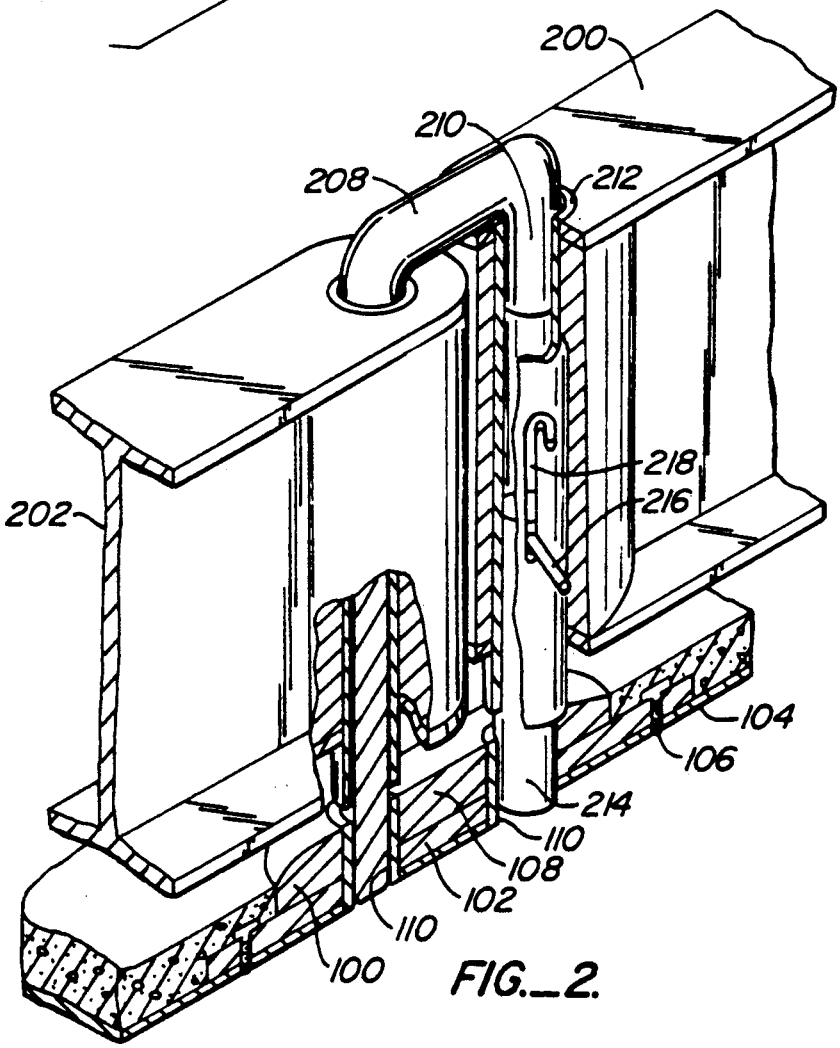
FIG. 2 is an elevational and partial sectional view of an alternative embodiment of this invention.

An alternative embodiment of the anchor unit is shown in FIG. 2. In this embodiment, the anchor 100 consists of a one inch thick base plate 102 formed from stainless steel. Base plate 102 is bolted to the bridge deck 104 by ⅜ inch stainless steel bolts 106. Welded to the center of base plate 102 is a raised button 108 formed from stainless steel. Button 108 is 1-½ inches high at the center.

Two elliptically shaped sockets 110 are disposed in button 108 and base plate 102. The elliptical shape allows for thermal expansion and contraction of the traffic barriers. The smaller diameter of sockets 110 is slightly larger than the diameter of the barrier pins. The size of the larger diameter depends on the temperature extremes of the bridge environment. The spacing of sockets 110 corresponds to the distance between the pins of adjacent barriers as shown in FIG. 2.

The preferred method of moving a line of barriers is as follows. Each barrier may be lifted out of its respective anchors by swing booms operated from a pair of trucks positioned at the ends of the barrier. The booms have hooks which mate with the lifting lug at the top of each pin. The barriers are moved sideways from one lane divider to another by the booms.

Figure 4:
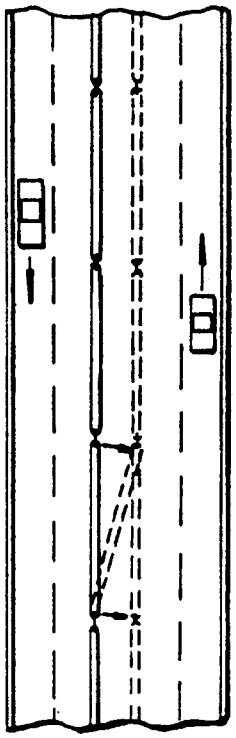
FIG. 4 is a schematic drawing showing movement of the barrier from one lane divider to another.

Power for the swing booms may come from the truck engines, from secondary engines mounted on the trucks or from a hand crank on the booms themselves. Moving a line of barriers from one lane divide to an adjacent lane divide requires the temporary closing of only one bridge lane as shown in FIG. 4.

Figure 3:
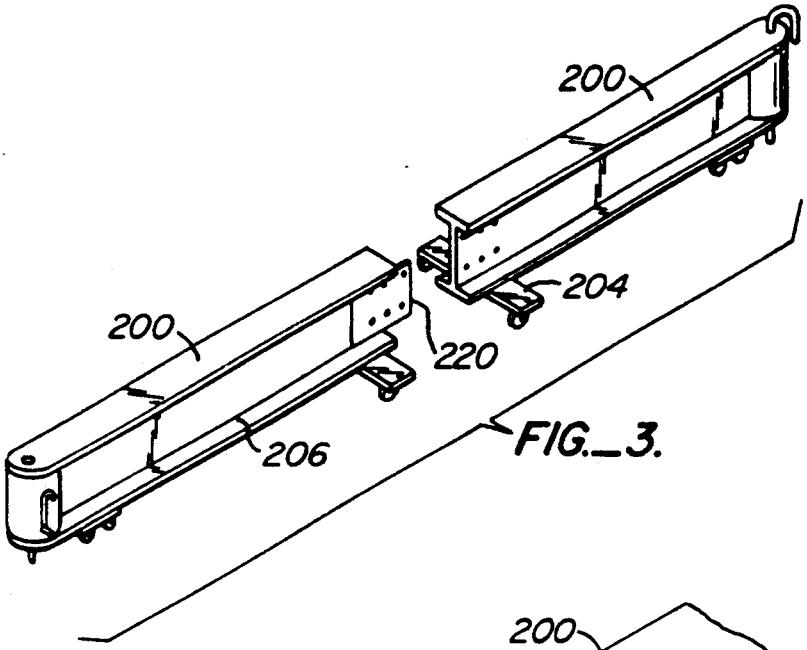
FIG. 3 is an elevational view of the embodiment of FIG. 2 shown detached from the road surface.

FIGS. 2 and 3 show an alternative embodiment of the movable barrier. In this embodiment, the barrier 200 is formed from one or more steel I-beams 202 mounted on casters or wheels 204. More than one I-beam may be combined to make a single barrier section by a steel plate 220 bolted to adjacent I-beams as shown in FIG. 3. The bolt holes may be elliptical to accommodate thermal expansion and contraction of the I-beam section. Each barrier section is mounted on one end by an inverted J-shaped pin 208 which mates with an anchor socket 110 as described above. The short end 210 of J-shaped pin 208 mates with a tube 212 formed in an adjacent barrier section. A shorter straight pin 214 is disposed at the other end of tube 212 of the adjacent barrier section and mates with an adjacent socket 110 in the bridge surface anchor 100. A handle 216 projects from shorter pin 214 through a J-shaped slot 218 formed in tube 212.

To move the barrier of the alternative embodiment, an operator lifts the J-shaped pin upwards and rotates it 180 degrees. This action frees one end of the barrier. The other end of the barrier is freed by lifting the straight pin via the handle and placing the end of the handle in the short section of the J-shaped slot. The barrier may then be rolled sideways to its new position.

It should be understood that the I-beam of this alternative embodiment may be replaced with the three-beam steel guardrail sections disclosed above.

FIG. 4 shows how the barrier may be moved by closing only one lane to traffic. Operators move one end of each barrier to its new position in an adjacent lane divider, either by using power booms with the first embodiment or by rolling on casters as in the second embodiment. The other end of the barrier follows in the next step of the moving operation. This stepwise movement prevents the exposure of an unprotected end of a barrier section to oncoming traffic.

Figure 5:
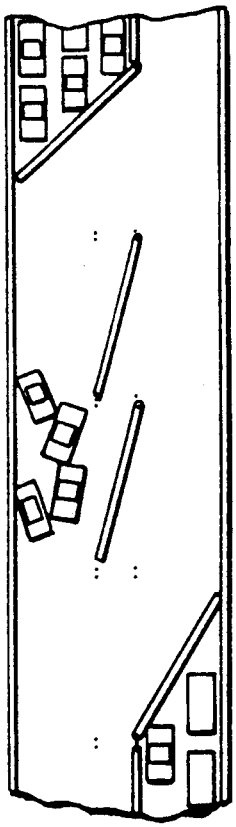
FIG. 5 is a schematic drawing showing the use of barriers according to this invention to control traffic in an emergency situation.

FIG. 5 shows a method for using the barrier to control traffic when emergency crews are attending to accidents on the bridge. Barriers may be swung about a single pin to completely block traffic in both directions to permit emergency vehicles to enter and leave the accident site. In addition, adjacent barrier sections may be used to create a safe space for disabled vehicles or accident crews on the road surface.

Furthermore, the barrier may be opened at any place along the lane divide to provide quick access wherever it is needed. Thus, the barrier according to this invention has three important safety features; (1) blocking traffic; (2) creating a safe place for emergency vehicles; and (3) opening at any point.

While this invention has particular application to bridge lane barriers, it should be understood that the invention may be applied to any roadway.

We claim:

1. A movable road barrier for guiding flow of traffic on a road surface comprising:

a beam extending lengthwise in a direction parallel to the flow of traffic for separating the flow of traffic; and means for removably attaching the beam to the road surface, said means comprising:

a pin disposed in an anchor in the road;

means for removing the pin from the anchor; and means for providing for a variable connection point between the pin and the anchor.

2. A movable road barrier for guiding flow of traffic on a road surface comprising:

a beam extending lengthwise in a direction parallel to the flow of traffic; and means for removably attaching the beam to the road surface, said means comprises:

a pin disposed in an anchor in the road immovably attached to the beam;

means for removing the pin from the anchor comprising means for lifting the pin and beam as a unit from the road and out of the anchor; and means for providing for a variable connection point between the pin and the anchor.

3. The barrier of claim 2 wherein the means for providing a variable connection comprises a slot formed in the anchor, the slot being longer than the diameter of the pin.

4. A movable road barrier for guiding flow of traffic on a road surface comprising:

a beam extending lengthwise in a direction parallel to the flow of traffic; and means for removably attaching the beam to the road surface, said means comprising:

a pin disposed in an anchor in the road movable with respect to the beam;

a handle for removing the pin from the anchor; and means for providing for a variable connection point between the pin and the anchor.

5. The barrier of claim 4 wherein the means for providing a variable connection comprises a slot formed in the anchor, the slot being longer than the diameter of the pin.

6. A movable road barrier for guiding flow of traffic on a road surface comprising:

a beam extending lengthwise in a direction parallel to the flow of traffic, wherein the beam comprises two three beam guardrail sections; and means for removably attaching the beam to the road surface, said means comprising:

a pin disposed in an anchor in the road;

means for removing the pin from the anchor; and means for providing for a variable connection point between the pin and the anchor.

7. The barrier of claim 6 wherein the beam further comprises a tube attached to one edge of the guardrail sections.

8. A movable road barrier for guiding flow of traffic on a road surface comprising:

a beam extending lengthwise in a direction parallel to the flow of traffic;

means for removably attaching the beam to the road surface, said means comprising:

a pin disposed in an anchor in the road;

means for removing the pin from the anchor; and means for providing for a variable connection point between the pin and the anchor; and means for rolling the beam from one position to another.

9. A movable road barrier for guiding flow of traffic on a road surface comprising:

a first beam extending lengthwise in a direction parallel to the flow of traffic for separating the flow of traffic;

means for removably locking the first beam to an adjacent beam; and means for removably attaching the first beam to the road surface, said means for attaching comprising a pin disposed in an anchor in the road and means for removing the pin from the anchor.

10. A movable road barrier for guiding flow of traffic on a road surface comprising:

a first beam extending lengthwise in a direction parallel to the flow of traffic;

means for removably locking the first beam to an adjacent beam, wherein the means for removably locking comprises a bar assembly attached to adjacent beams at two points on each beam; and means for removably attaching the first beam to the road surface, said means for attaching comprising a pin disposed in an anchor in the road and means for removing the pin from the anchor.

11. The barrier of claim 10 wherein the pin is immovably attached to the beam, the means for removing comprising means for lifting the pin and beam as a unit from the road and out of the anchor.

12. The barrier of claim 11 further comprising means for providing a variable connection, said means comprising a slot formed in the anchor, the slot being longer than the diameter of the pin.

13. The barrier of claim 10 wherein the pin may be moved with respect to the beam, the means for removing comprising a handle for moving the pin.

14. The barrier of claim 13 further comprising means for providing a variable connection, said means comprising a slot formed in the anchor, the slot being longer than the diameter of the pin.

15. The barrier of claim 10 wherein the beam is formed from two three-beam guardrail sections.

16. The barrier of claim 15 wherein the beam further comprises a tube attached to one edge of the guardrail sections.

17. The barrier of claim 10 further comprising means for rolling the beam from one position to another.

18. A movable road barrier for guiding flow of traffic on a road surface comprising:

a beam extending lengthwise in a direction parallel to the flow of traffic for separating the flow of traffic; and means for removably attaching the beam to the road surface, said means comprising:

an anchor comprising a plate attached to the road surface, a pin disposed in an opening fromed in the anchor, and means for removing the pin from the anchor.

19. A movable road barrier for guiding flow of traffic on a road surface comprising:

a beam extending lengthwise in a direction parallel to the flow of traffic; and means for removably attaching the beam to the road surface, said means comprising:

an anchor comprising a plate attached to the road surface and having an opening formed therein, wherein the anchor opening is formed as a slot whose length along the axis parallel to the beam is longer than its width, a pin disposed in the opening, and means for removing the pin from the anchor.

20. The barrier of claim 19 wherein the anchor further comprises a stiffener disposed in the slot.

21. The barrier of claim 20 wherein the pin is immovably attached to the beam, the means for removing comprising means for lifting the pin and beam as a unit from the road and out of the anchor.

22. The barrier of claim 21 further comprising means for providing a variable connection, said means comprising a slot formed in the anchor, the slot being longer than the diameter of the pin.

23. The barrier of claim 20 wherein the pin may be moved with respect to the beam, the means for removing comprising a handle for moving the pin.

24. The barrier of claim 20 further comprising means for providing a variable connection, said means comprising a slot formed in the anchor, the slot being longer than the diameter of the pin.

25. The barrier of claim 20 wherein the beam is formed from two three-beam guardrail sections.

26. The barrier of claim 25 wherein the beam further comprises a tube attached to one edge of the guardrail sections.

27. The barrier of claim 20 further comprising means for rolling the beam from one position to another.

* * * * *